United States Patent [19]

Strain

[11] 4,419,835

[45] Dec. 13, 1983

[54] HAIR DRYER

[75] Inventor: Don R. Strain, Clarkston, Mich.

[73] Assignee: H.D. Research Company, West Bloomfield, Mich.

[21] Appl. No.: 259,121

[22] Filed: Apr. 30, 1981

[51] Int. Cl.[3] ..... F26B 21/08

[52] U.S. Cl. ..... 34/80; 34/99; 34/100; 55/179

[58] Field of Search ..... 34/80, 99, 100, 97, 34/81; 55/179, 208

[56] References Cited

U.S. PATENT DOCUMENTS

| | | | |
|---|---|---|---|
| 2,376,095 | 5/1945 | Shoeld | 34/80 |
| 2,563,042 | 8/1951 | Jaubert | 34/80 |
| 2,735,507 | 2/1956 | Vogel | 34/80 |
| 2,738,592 | 3/1956 | Stanley | 34/80 |
| 2,773,313 | 12/1956 | O'Connor | 34/80 |
| 3,304,623 | 2/1967 | Reiss et al. | 34/80 |
| 3,513,631 | 5/1970 | Seibert et al. | 55/179 |
| 3,803,724 | 4/1974 | Bombich | 34/80 |

*Primary Examiner*—Larry I. Schwartz

*Attorney, Agent, or Firm*—Cullen, Sloman, Cantor, Grauer, Scott & Rutherford

[57] ABSTRACT

A hair dryer has first and second air passage desiccant bed ducts with inlets communicating with an inlet air plenum and outlets communicating with an outlet plenum having a restricted dry air outlet. A plurality of longitudinally spaced porous baffles, each containing a water adsorbent desiccant material mounted within each duct. A first movable closure in the inlet plenum in a first position directs air through the first duct for circuitous passage through the baffles to the outlet plenum for delivery of dried air through its air outlet. Opposed exhaust air outlets on the inlet plenum communicate with the inlets of the ducts. One closure of a pair of pivotal outlet closures in a first position normally closes the exhaust outlet at one duct in the inlet plenums the other closure in its first position being normally open and adapted in a second position to close the exhaust outlet at the other duct in the inlet plenum. The closures are interconnected for movement in unison between first and second positions. A portion of the dry air in the outlet plenum passes into the outlet of the second duct for dehydrating and regenerating the desiccant within the baffles therein, the air exhausting through one exhaust inlet in the inlet plenum to atmosphere. An intermittently operable timer controlled solenoid is connected to one closure for moving all of the closures simultaneously to a second position whereby ambient air is directed by the first closure to the second duct for passage therethrough and entry into the outlet plenum for passage through the dry air outlet, with some of the dry air returning in the opposite direction through the outlet of the first air passage duct for dehydrating and regenerating the desiccant material within the baffles therein, the air exhausting through the other exhaust outlet in the inlet plenum to atmosphere.

7 Claims, 2 Drawing Figures

HAIR DRYER

BACKGROUND OF THE INVENTION

Conventional hair dryers, dryers for clothing, dehumidifiers and air conditioners normally include a source of heat applied to the moving ambient air. Much of the ambient air has a load of water therein normally requiring heat energy at the same time as the air is warmed. Often times the use of the heated air, particularly in hair dryers, provides for the delivery of drying air through a bonnet which is uncomfortably warm to the user.

Various efforts in the prior art have been made to predry air for various purposes.

THE PRIOR ART

Illustrative efforts in this direction are set forth in one or more of the following U.S. patents:

U.S. Pat. No. 3,257,738—T. Margittai—June 28, 1966

U.S. Pat. No. 3,596,367—A. R. Crandall—Aug. 3, 1971

U.S. Pat. No. 3,875,679—Robert Condit—Apr. 8, 1975

U.S. Pat. No. 3,854,224—Yamaji et al—Dec. 17, 1974

U.S. Pat. No. 3,256,613—L. E. Moulthrop—June 21, 1966

SUMMARY OF THE INVENTION

An important feature of the present invention is to provide an apparatus which is a unique energy saving means for drying various materials such as human hair, clothing or for dehumidifying various enclosures such as for rooms, buildings or in conjunction with air conditioning.

An important objective of this invention is to provide a dryer for materials such as human hair or clothing which involves passing the air to be treated through a plurality of baffles containing a water adsorbent desiccant to make the air more hygroscopic and thereafter continuously passing the dried air over the wet material until such air has absorbed the desired amount of water therefrom. A further feature is to render the ambient air more hygroscopic by removing the existing water load therefrom and using such air at an ambient temperature to dry materials with or without heating.

A further feature includes application of heat to the dried air before it is passed over the wet material. In a hair dryer, the dry air feels cold and the heater is primarily for comfort. The heating of the dry air is also more energy efficient, since no energy is used to heat the original water load which has already been removed with the passage of the air through the desiccant material. The capacity of the heated dry air for water absorbing has been increased. A further feature of the present air dryer is to employ alternately one of a pair of desiccant bed ducts or passages to remove the existing ambient air water load in a continuous regenerative system, wherein there is no increase in energy consumption required for the regeneration and drying of the desiccant material, since no further energy is required. A further reduction of the drying time is achieved if heat is applied to the dried air.

A further feature provides in conjunction with a pair of air flow ducts a series of longitudinally spaced perforated baffle assemblies, each containing a water adsorbent desiccant. Ambient air delivered from an inlet plenum passes through one of the ducts into an outlet plenum having a restricted air outlet or Venturi for the delivery of dry air therefrom. Such restriction produces a back pressure in the outlet plenum, whereby a portion of the moving air therein is returned in the reverse direction through the second of the air ducts for passage over the baffle assemblies therein drying the desiccant materials within said baffle assemblies and for exhaustion to atmosphere.

A further feature includes the use of a plurality of air flow control doors or outlets each interconnected and all biased into a first position and adapted for movement in unison to a second position wherein one door controls the direction of pressurized air from the inlet plenum to one of the air passage ducts, with one of the exhaust doors closed and with the other of the exhaust doors open so that some of the air returning from the outlet plenum moves in the opposite direction over the other of the two air passage ducts for drying the dessicant materials therein and for exhausting to atmosphere. There is further employed an intermittently operable power means connected with a timer for simultaneously moving the doors from their first positions to their second positions thereby switching the flow of pressurized air from the inlet plenum to the second of the two air passage ducts and reversing the operation in a continuous manner wherein a portion of the dried air in the outlet plenum is returned in the opposite direction through the other of the two air passage ducts for exhausting to atmosphere.

These and other objects will be seen from the following specification and claims in conjunction with the appended drawing.

THE DRAWING

Figure 1:
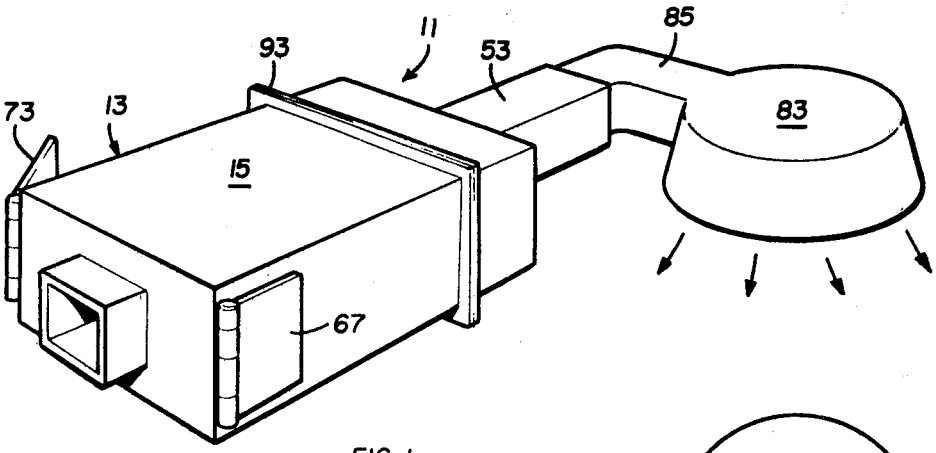
FIG. 1 is a front perspective view of a hair dryer in accordance with the present invention.

It will be understood that the drawing illustrates a hair dryer as one preferred embodiment of the invention and that other embodiments are contemplated within the scope of the claims hereafter set forth.

DETAILED DESCRIPTION OF ONE EMBODIMENT OF THE INVENTION

Referring to the drawing, a hair dryer is generally indicated at 11, FIG. 1 having a housing 13, with top wall 15, bottom wall 17, side walls 19, front wall 21 having air inlet 23 and rear wall 25 having restricted dry air outlet 27.

Figure 2:
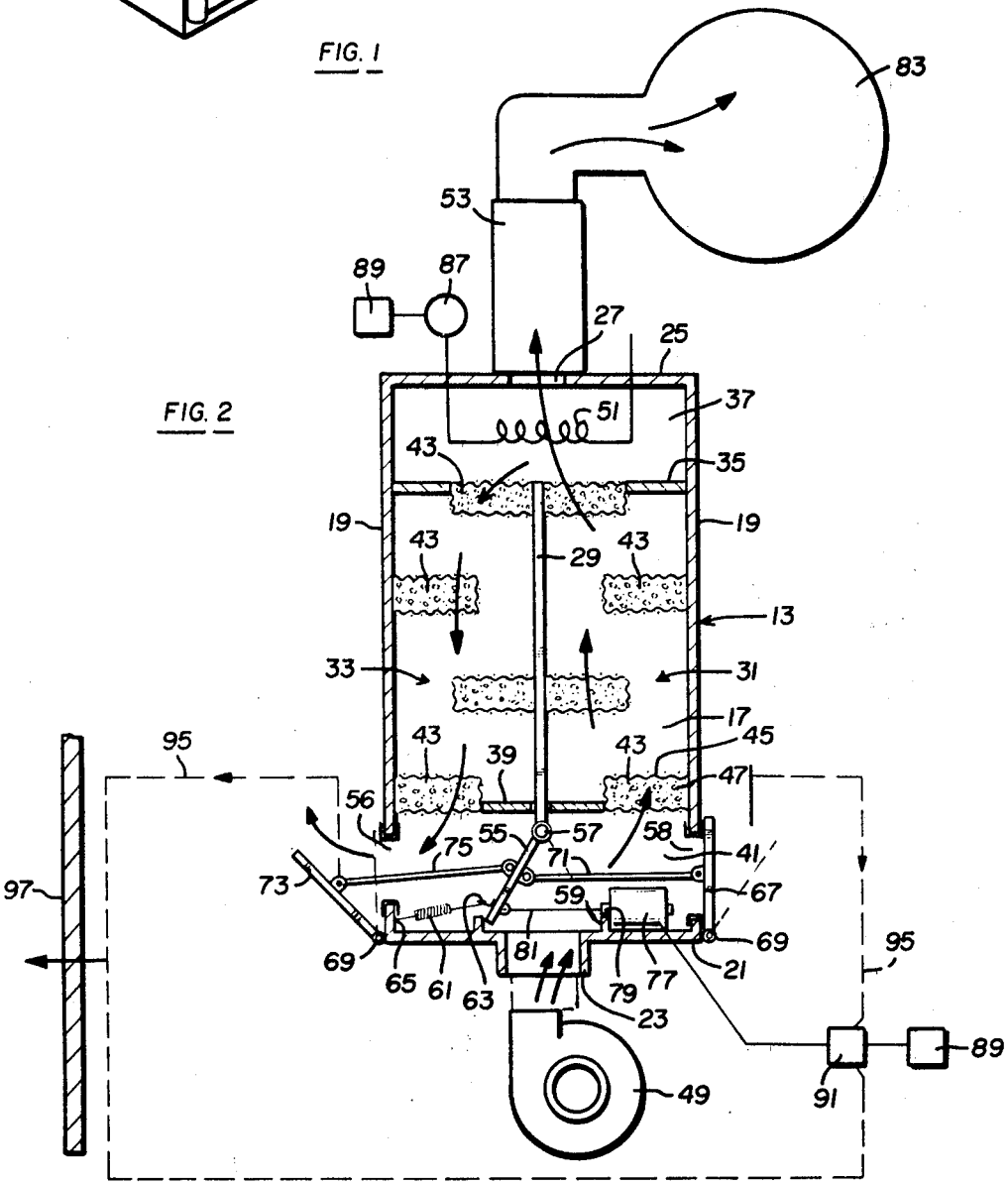
FIG. 2 is a fragmentary plan section thereof for the delivery of pressurized ambient air alternately through a pair of desiccant containing air passage ducts for delivery to a restricted air outlet and for the partial return of some of the dried air to the other of the pair of air ducts for dehydration and regeneration of the desiccant material therein.

A pair of longitudinally spaced partitions 35, 39 are spaced inwardly of rear wall 25 and front wall 21, extend between the top and bottom walls, defining within said housing air inlet plenum 41 communicating with air inlet 23 and outlet plenum 37 in communication with restricted dry air outlet 27, FIG. 2.

While the above housing has been shown for illustration as one form for providing first and second air flow desiccant bed ducts 31 and 33, it is contemplated that these ducts may be formed in any other manner such as by the use of a pair of parallel spaced tubes.

A plurality of transverse longitudinally spaced laterally staggered perforated baffle assemblies 43 are mounted within each of the air passages within said housing and spaced along the length of the first and second air flow ducts 31 and 33.

The perforated baffle assemblies 43 in the disclosed embodiment are constructed of a wire screening 45, ⅛ inch mesh aluminum wire for illustration, having dimensions 4 inches by 4 inches by 8 inches, for illustration only, containing a suitable desiccant material. A suitable desiccant is activated aluminum oxide, referred to as alumina, in the forms of beads or pellets having a size as would pass through a screen mesh 0.25 inches for illustration.

While other desiccants may be employed such as granular silica-gel, it is contemplated that the preferred desiccant is a porous aluminum oxide of a particulate form and preferably in the form of beads to facilitate the passage of ambient air through the perforated baffle assemblies. These are arranged along the length and alternately staggered within the respective air flow ducts 31 and 33.

As shown in FIG. 2, the perforated baffle assemblies 43 within the ducts 31 and 33 are laterally aligned and are arranged alternately within a particular duct, so that the ends of the respective baffle assemblies alternately engage side walls 19 and the partition 29. This provides a circuitous passage of the pressurized ambient air passing through said ducts alternately.

As schematically shown in FIG. 2, air blower 49 is connected to inlet 23 and inlet air plenum 41. A suitable air blower is sold by Fasco Industries, Inc., model 50761-5223 operating at 150 volts AC, 60 HZ, 1.45 amps. The air blower is adapted to deliver ambient air at approximately 120 cubic feet per minute and creates a static pressure of approximately 0.5 inches of water.

Electric resistance heater 51, such as a cal rod heater, is nested within outlet air plenum 37 in the path of movement of dry air therethrough and is adapted to heat the dry air that passes through the restricted outlet orifice 27. The air then passes through outlet sleeve 53 connected to housing 15 and at one end mounting the dry air diffusing bonnet 83. A pair of cal-rod heater elements may be employed as schematically shown at 51 delivering 200 watts and 500 watts energized singly or combined, for illustration. The electric resistance heater 51 is interposed in a circuit which includes normally open switch 87 connected to a suitable power source 89.

A first pivotal door 55 or closure is mounted within inlet air plenum 41 and in its first position directs ambient air from the blower 49 into the first air passage duct 31 for circuitous passage through the perforated baffle assemblies 43 and into the outlet plenum 37. The dried air is delivered through dry air outlet 27 and passage 53 to and through air bonnet 83 for drying wet hair, for illustration.

First door 55 in its initial first position bears against one stop 59 within the inlet bonnet 41 and is biased in that position by the coil spring 61 connected thereto at 63 and anchored to the inlet plenum at 65. First pivotal door 55 is adapted for movement to a second position shown in dash lines with respect to the additional stop 59.

A pair of opposing exhaust air outlets 56 and 58 are at the ends of the inlet plenum 41 and are adapted for communication with the respective adjacent inlets of the air passage ducts 31 and 33. A pair of spaced pivotal outlet doors or closures 67 and 73 are pivoted to opposite ends of the air inlet plenum as at 69. One door 67 in a first position normally closes the exhaust outlet 58 at one end of air passage duct 31. The other door 73 in its first position is normally open and is adapted in its second position to close the exhaust outlet 56 at one end of the second air duct 33.

A pair of substantially aligned links 71 and 75 at their inner ends are pivotally connected to opposite sides of the first pivotal door 55 and at their outer ends are pivotally connected at their respective exhaust control doors 67 and 73.

FIG. 2 shows the respective doors in their first position. The doors are adapted for movement in unison to their second position such as shown in dash lines. There is employed an intermittently operable power means such as the solenoid 77 having a retractable plunger 79 connected to door 55 by link 81.

In the disclosed embodiment, the solenoid 77 is a Dormeyer pull type solenoid, 115 volts AC, 60 HZ, 0.60 amps. The solenoid is connected into an electrical power circuit, which includes cycle timer 91 and a power source 89. The timer in this embodiment is a Dayton Cycle Timer Model ZE130, which may be set in the illustrative embodiment for 1.5 minute time cycles.

The solenoid 77 is therefore deactivated for 1.5 minutes and is alternately energized for a period of 1.5 minutes before returning to its initial deactivated position under the bias of coiled spring 61. The time may be modified as desired by adjusting the timer clock 91 for the predetermined time interval desired.

In the position of the doors shown in FIG. 2, some of the dry air delivered into exhaust plenum 37, due to the back pressure developed therein from the restricted opening or orifice 27 is adapted to flow in the opposite direction passing into the second air duct 33 through the corresponding perforated baffle assemblies therein. This is for the purpose of dehydrating and regenerating the desiccant material within the baffle assemblies and with the passing air exhausting through the outlet 56 and open door 73.

After a predetermined interval and upon energization of the normally deactivated solenoid 77, all of the doors switch from the solid line first position shown to the dash line second position. The ambient air delivered by the blower 49 moves into the second air passage duct 33 to the outlet plenum 37 for movement through the restricted dry air outlet 27 and passage 53 to bonnet 83. Some of the dry air due to the back pressure developed within outlet plenum 37 returns in the opposite direction through the first air passage duct 31 for dehydrating and regenerating the desiccant material within the perforated baffle assemblies. The air then exhausts through the other outlet 58 and then open exhaust control door 67 shown in its dash line position.

In the illustrative embodiment at one end of the outlet sleeve 53 is a connector pipe 85 for mounting, supporting and conducting dry air into and through dry air diffusing bonnet 83, as shown by the arrows in FIG. 1.

For some operations of the present hair dryer, the control switch 87 to the electrical power source for the heater 51 is left off. The dry air without heating moves through the restriced outlet 27 to bonnet 83. As desired and on activation of the switch 87, electrical power is provided to the coil 81 for heating the dried air to the extent needed.

Schematically shown in FIG. 1 is a transversely arranged support assembly 93 as one means by which the present heater may be supported within a room area such as in a beauty parlor or in the home. When the present air dryer is utilized as a dehumidifier or for providing dried air to the inlet of an air conditioner, or for drying clothes, the respective exhaust outlets 56 and 58 have connected thereto the conduits 95 shown in dash lines, which extend through the building or room wall 97. Thus, the return exhaust air picks up water in passing through the desiccant containing baffle assemblies and outlets to the outside of the room building wall 97 to maintain low humidity therein.

OPERATION

A dried air supplied through the restricted orifice 27 of the outlet plenum 37 is rendered more hygroscopic since a substantial portion of the water load therein has been removed by passage through the drying ducts 31 or 33. In the position of the first door 55, FIG. 2 and with solenoid 77 deactivated, the air flow from blower 49 flows into air passage duct or desiccant bed 31 blocking air flow towards the second desiccant bed 33.

Exhaust control pivotal door 67 is closed forcing all of the air flow through air passage 31 where the ambient air water load is removed by adsorption by the desiccant material within the series of baffle assemblies 43. The dry air flows out of desiccant bed 31 into the outlet plenum 37 and passes over the electric heating element 51 which may be energized as desired to the switch 87, then through the restricting orifice 27 and the air diffusing bonnet 83 and over the hair to be dried.

The restricting orifice 27 creates a differential pressure or back pressure within plenum 37 which causes a portion of the dry air therein to flow through the desiccant bed 33 in the opposite direction to the flow through desiccant bed 31. This small flow of dry air is sufficient to remove any water which is collected by the desiccant material in bed 33 from the previous passage of air therethrough, thereby regenerating it and continuously flowing through the open exhaust door 73 to atmosphere.

After a specific period of time, such as 1.5 minutes, for example in a particular application, the air flows are reversed. All of the doors simultaneously move by the solenoid 77 to the dash line position shown in FIG. 2. In this position, door 55 causes air flow through air passage bed 33 while blocking air flow through air passage bed 31.

Door 73 is closed forcing the air flow through desiccant bed 33, and door 67 is open to the dash line position shown to atmosphere, allowing regeneration air to flow through desiccant bed 31 and through exhaust outlet 58 of inlet plenum 41.

In the case of commercial hair dryers, less energy will be consumed for facilitating air conditioning because less heat will be released into the facilities ambient air. The process of obtaining hygroscopic air to dry other mterials, such as clothing is the same with the respective components and ducts sized for the application of the dry air directed over the wet material other than hair.

The present embodiment may also be employed for dehumidifying enclosures with respect to walls 97 shown in FIG. 2 such as in rooms or buildings which involve the use of air conditioning for refrigeration. Therefore the above described air dryer may be employed to regulate the relative humidity of enclosures that are subject to a higher relative humidity then desirable.

While the use of electric resistance heater 51 or air dryer is selective, it is primarily used not so much for heating but for the comfort of the user wherein the temperatures created thereby do not exceed 85 to 95 degrees, F. Employing the present dryer for hair, the conventional 20 minute time employed for drying is reduced to 5 minutes, for illustration.

The present dryer may be employed for any drying system other than hair drying, as for example the drying of clothes or for dehumidifying a room area. The present dryer reduces air energy consumption because heating is applied to air already dried passing through the air passage ducts 31 or 33 alternately. Thus, the water load has been removed from the air before heating.

The cycle of operation of the present hair dryer or other air dryer is automatic and continuous for the delivery of dry air to the outlet plenum 37 and the recirculation of some of the dry air for regenerating and dehydrating the desiccant material within the respective perforated baffle assemblies.

Since the solenoid 77 is controlled by an automatic timer 91, the periods of time of the air passing through duct 31 and with some exhausting and desiccant regeneration through duct 33 can be controlled. Normally the periods are equal since the solenoid 71 is normally deenergized and under the control of timer 91. In accordance with the present invention, solid desiccant alumina for illustration can be reactivated and regenerated for indefinate periods. One source of alumina beads 47 is Alcoa Company.

The use of the present dual chamber system alternately utilizing the desiccant for drying the air and for alternately drying the desiccant material is a continuous process of alternate water adsorption and regeneration or water removal by and from the desiccant material.

Having described my invention, reference should now be had to the following claims:

I claim:

1. A dryer comprising:

an enclosed housing including an air inlet and an air outlet;

opposed first and second flow desiccant bed ducts on each side of said inlet and outlet;

an inlet plenum located between said inlet and said opposed flow ducts and an outlet plenum located between said outlet and said opposed flow ducts;

said inlet and outlet plenums communicating through said flow ducts;

a valve door pivotally supported within said housing having one end extending across said inlet to direct air received from said inlet into one of said flow ducts in a first pivotable position and into said opposite flow duct in a second pivotable position;

door actuating means intermittently pivoting said valve door between said first and second positions to alternately and intermittently direct air into one of said first and second flow ducts;

blower means directing air into said inlet;

said flow ducts each comprising perforated baffle assemblies of loosely packed desiccant material having a low pressure drop across each baffle assembly;

a heater means, positioned within said outlet plenum in the air path therein, adapted for heating the dehydrated air passing through said outlet plenum rendering said dry air more hygroscopic for increased drying of the air passing through said outlet and the air returning through the other of said flow ducts for rapid regeneration of said baffle assemblies;

valve means in said inlet plenum;

said valve means alternately directing air received from one of said flow ducts out of said housing;

said blower means directing air into said inlet;

said valve door and door actuating means alternately and intermittently directing said air into one of said flow ducts, into said outlet plenum, and a large portion of said air out of said outlet;

said outlet being a restricted opening and creating a back pressure in said outlet plenum directing a portion of air received from said opposed flow duct into the opposite flow duct; and said valve means directing said portion of air received from said opposed flow duct out of said housing.

2. The dryer defined in claim 1, wherein said heater means includes an electric resistance heater coil selectively adjustable for producing heat in the range of 200 to 700 watts, approximately.

3. The dryer defined in claim 1, wherein said heater means provides drying air through said air outlet in a temperature in the range 80° to 90° F., approximately.

4. In the dryer defined in claim 1, wherein said baffle assemblies contain a desiccant material being alumina.

5. The dryer defined in claim 1, further comprising an air diffusing bonnet connected to said dry air outlet for directing dry air onto a persons wet hair.

6. The dryer defined in claim 5, wherein the connection of said bonnet to said air outlet includes an outlet sleeve at one end connected to said outlet plenum in communication with said dry air outlet, and at its other end connected to and supporting said bonnet for delivering dehydrated air therethrough.

7. The dryer defined in claim 1, wherein each of said baffle assemblies includes a hollow enclosure of wire mesh screening, a desiccant material being of particular form and loosely netted in each of said baffle assemblies.

* * * * *